US005752334A

United States Patent [19]

Immel

[11] Patent Number: 5,752,334

[45] Date of Patent: May 19, 1998

[54] DUMPING SYSTEM FOR A DRAGLINE BUCKET

[75] Inventor: Darryl R. Immel, Waterford, Wis.

[73] Assignee: Harnischfeger Corporation, Milwaukee, Wis.

[21] Appl. No.: 752,457

[22] Filed: Nov. 15, 1996

[51] Int. Cl.[6] ..... E02F 3/60; E02F 3/48

[52] U.S. Cl. ..... 37/396; 37/394; 37/397

[58] Field of Search ..... 37/379, 396, 403, 37/443; 171/16; 172/254, 272, 785, 265; 404/127; 414/694

[56] References Cited

U.S. PATENT DOCUMENTS

| | | | |
|---|---|---|---|
| 838,892 | 12/1906 | Page | 37/396 |
| 1,017,293 | 2/1912 | Johnson | 37/396 |
| 1,383,913 | 7/1921 | Dutcher | 37/396 |
| 2,229,351 | 1/1941 | Spencer, Jr. | 37/396 |
| 2,359,303 | 10/1944 | Davidson | 37/396 |

*Primary Examiner*—Terry Lee Melius
*Assistant Examiner*—Robert Pezzuto
*Attorney, Agent, or Firm*—Richard C. Ruppin; James Earl Lowe, Jr.

[57] ABSTRACT

A draglined bucket having first and second contoured dumping rails respectively supported on first and second spaced apart opposite sidewalls and a rear wall. Each dumping rail extends from above the sidewall on which it is supported to the rear wall on which it is also supported. Rollers are connected to a hoist rope and support the bucket in a suspended manner. The rollers engage the first and second dumping rails and are movable along the dumping rails from a forward position in which an open end of the bucket faces substantially horizontally, to a rearward position in which the open end of the bucket faces downwardly to dump material in it. The dumping rails adjacent to the rear wall of the bucket are preferably spaced from the rear wall of the bucket. The rollers include first and second rollers which respectively engage the undersides of the first and second dumping rails. Each dumping rail may be angled relative to the sidewall on which it is supported in an upward direction toward the opposite sidewall. The first and second rollers are separately connected to first and second hoist chains which extend from above the bucket at an angle toward the dumping rails and the first and second rollers each have an axis which is substantially perpendicular to the lengths of the respective first and second hoist chains. Each of the dumping rails is spaced from the rear of the bucket.

15 Claims, 5 Drawing Sheets

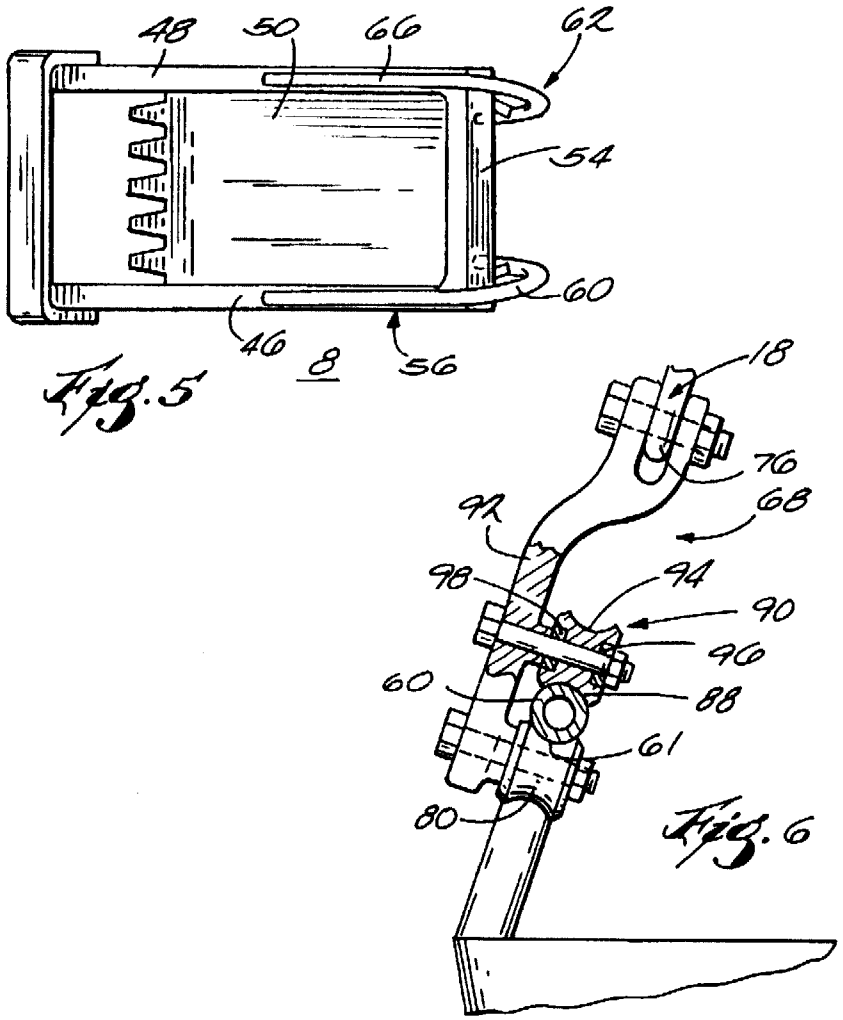
Fig. 5
Fig. 6
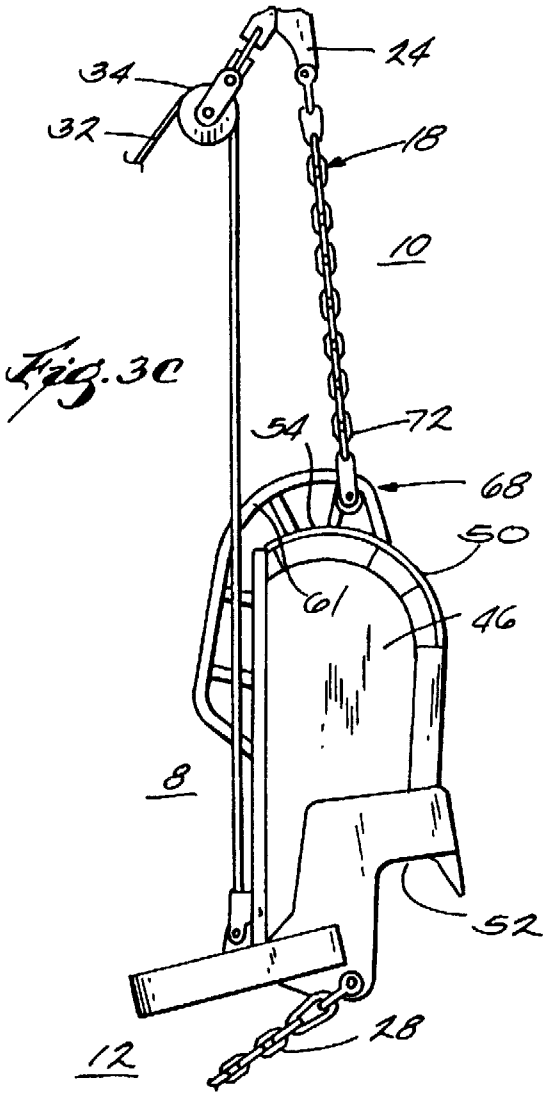
Fig. 3C

DUMPING SYSTEM FOR A DRAGLINE BUCKET

FIELD OF THE INVENTION

This invention relates generally to buckets used in surface mining equipment for digging, scraping, dragging and excavating and, more particularly, to systems for dumping such buckets.

BACKGROUND OF THE INVENTION

Dragline buckets are used for various purposes such as open cast surface mining. In such operations, buckets are suspended from angularly upward extending booms or the like by a hoist line, and are manipulated by the hoist line, draglines, dump ropes, and sometimes other types of control lines, to dig or scrape earth from one location into the bucket and move the earth filled bucket to another location where it is dumped. Because of the size and cost of the machinery involved, it is highly desirable to obtain maximum use of the machinery in order to correspondingly achieve maximum cost efficiency. The design of the buckets used with such machinery must accordingly be as easy to use as possible.

One of the important aspects of dragline bucket design is the manner of connection of the hoist mechanism attached to the bucket which lifts and lowers the bucket and sometimes assists in the dumping of the bucket. Bucket hoist mechanisms are normally connected to trunnions affixed to either the outer side walls or the inner side walls of the bucket. Buckets having outside hoist trunnions require hoist chains having a lower section connected to the trunnions by trunnion links and a spreader bar between the lower hoist chain sections leading to each of the opposite sides of the bucket. Hoist trunnion deflectors may also be affixed to the bucket sides in front of the trunnions to deflect the flow of the material being dug away from the hoist trunnions. Due to the location of these items and their protrusion from the sides of the bucket, they reduce the efficiency of dragging the bucket through the material. They also wear quickly due to the abrasive nature of the material sliding and flowing along them. The spreader bar is required to prevent the lower section of the hoist chains from rubbing on the sides of the bucket and adds significant weight to the bucket rigging assembly. Further, if the operator of the dragline lowers the hoist rigging too far and too quickly, the spreader bar will impact the bucket and cause damage to both the bucket and the bar.

There have been various attempts to solve the problems of outside mounted bucket trunnions including mounting the trunnions on the inside walls of the bucket. With trunnions affixed to the inside walls of the bucket, the need for a spreader bar and thereby the weight of the spreader bar is eliminated. Although inside trunnions accomplish weight reduction, the inside trunnions protrude inside the bucket and continue to have the problem of material flowing past and around the trunnions, links and chains, causing wear to all of these items. Further, inside trunnions to some extent tend to prevent compacting of material inside the bucket to reduce bucket pay load. In wet digging conditions, inside trunnions tend to cause material to build up inside the bucket which does not dump out completely, thus creating a "carry-back" condition. Carry-back material reduces the capacity of the dragline bucket and thereby lowers the overall productivity rate of the entire dragline. Inside trunnion buckets also must have a lower rear wall such that the hoist chains clear the rear wall of the bucket in order to allow the bucket to hang in a relatively vertical position for dumping purposes.

As a result, there is not as large of a rear wall against which material may compact. Material will simply flow over the back of the bucket so that the payload of the bucket is reduced.

The present invention is directed toward an improved dumping system which overcomes the problems of both inside and outside mounted trunnions on the side walls of a dragline bucket.

SUMMARY OF THE INVENTION

It is generally an object of this invention to provide a dragline bucket dumping system in which trunnions affixed to the walls of the bucket are not required.

The invention is carried out in a dragline bucket by providing the bucket with first and second contoured dumping rails respectively supported on first and second spaced apart sidewalls and a rear wall connecting the two side walls. Each dumping rail extends from above the sidewall on which it is supported to the rear wall on which it is also supported. Roller means is connected to hoist means and support the bucket in a suspended manner. The roller means engages the first and second dumping rails and is movable along the dumping rails from a forward position in which an open end of the bucket faces substantially horizontally, to a rearward position in which the open end of the bucket faces downwardly and material in the bucket is dumped. The dumping rails adjacent to the rear wall of the bucket are preferably spaced from the rear wall of the bucket and the roller means has first and second roller means which respectively engage the undersides of the first and second dumping rails. Each dumping rail may be angled relative to the sidewall on which it is supported and transversely to its length in an upward direction toward the opposite sidewall on which the other dumping rail is supported. The first and second roller means are separately connected to first and second hoist chains which extend from above the bucket at an angle toward the dumping rails and the first and second rollers each have an axis which is substantially perpendicular to the lengths of the respective first and second hoist chains. Each of the dumping rails is spaced from the rear of the bucket. Also, the dumping rail may have a contour shape along its length which has a controlling affect on the movement of the bucket along the dumping rails. The roller means may also include rollers engaging the upper sides of the dumping rails and means for limiting the speed of the rollers such as brake or clutch mechanisms.

BRIEF DESCRIPTION OF THE DRAWINGS

The foregoing and other objects of the invention will be apparent from the detailed description which follows taken in conjunction with the following drawings:

FIG. 3C is a bucket as shown in FIG. 3A with the open end of the bucket facing downward and the bucket in a full dump position;

FIG. 5 is a top plan view of the bucket shown in FIG. 3A; and

FIG. 6 is a rear elevation view, in cross-section, illustrating an alternative embodiment of the invention;

DESCRIPTION OF THE PREFERRED EMBODIMENT

Figure 1:
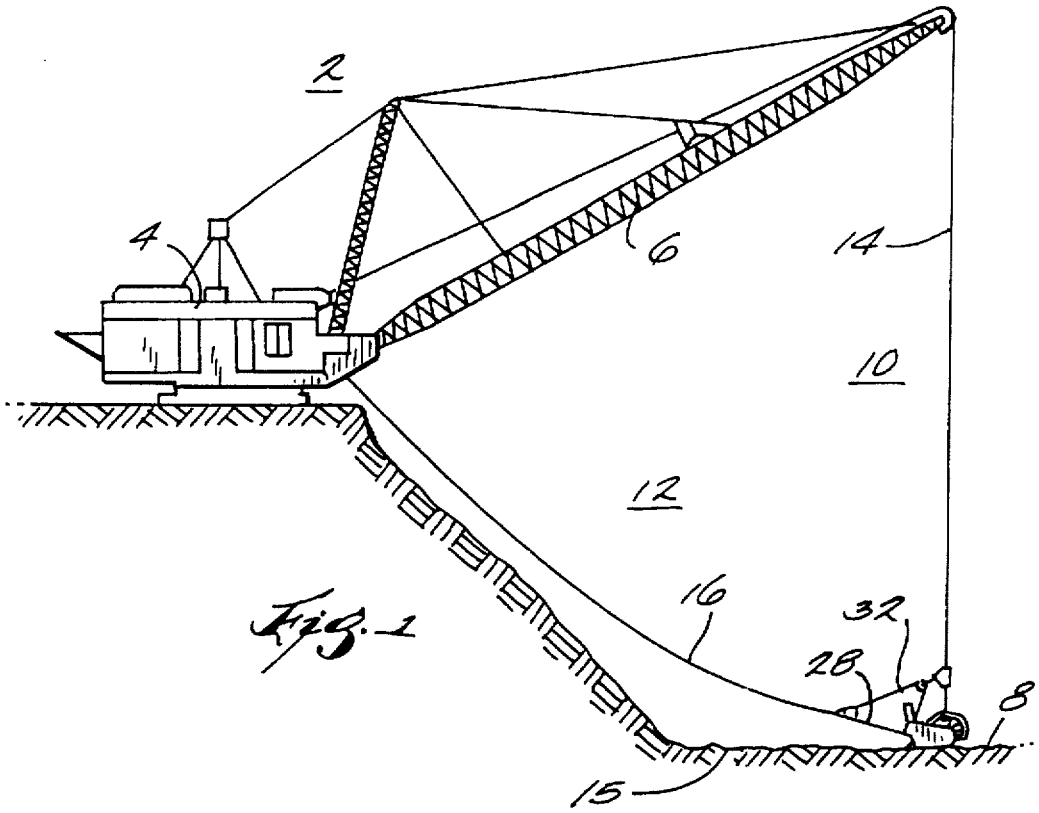
FIG. 1 is a side elevation view of a dragline in operation.

With reference to FIG. 1, a dragline 2 comprises a housing and frame 4 including a machinery house and operator's cab, a boom 6 extending angularly upward from the main housing and frame, a bucket hoist system 10 and a bucket drag system 12. A bucket 8 is connected to the bucket hoist system 10 and the bucket drag system 12 and can be swung in directions substantially parallel to the ground 14 by swinging the bucket from the boom. The bucket hoist system 10 and bucket drag system 12 respectively include a hoist rope 14 and a drag rope 16 which are taken in or paid out by drive means (not shown) within the main housing and frame 4. The bucket 8 is dragged along the ground 15 when the drag rope 16 is taken in to scrape material comprising part of the ground 15 into the bucket. Controls for the operation of the hoist system, the drag system and the swing drive system are located within the operator's house on the housing and frame 4.

Figure 2:
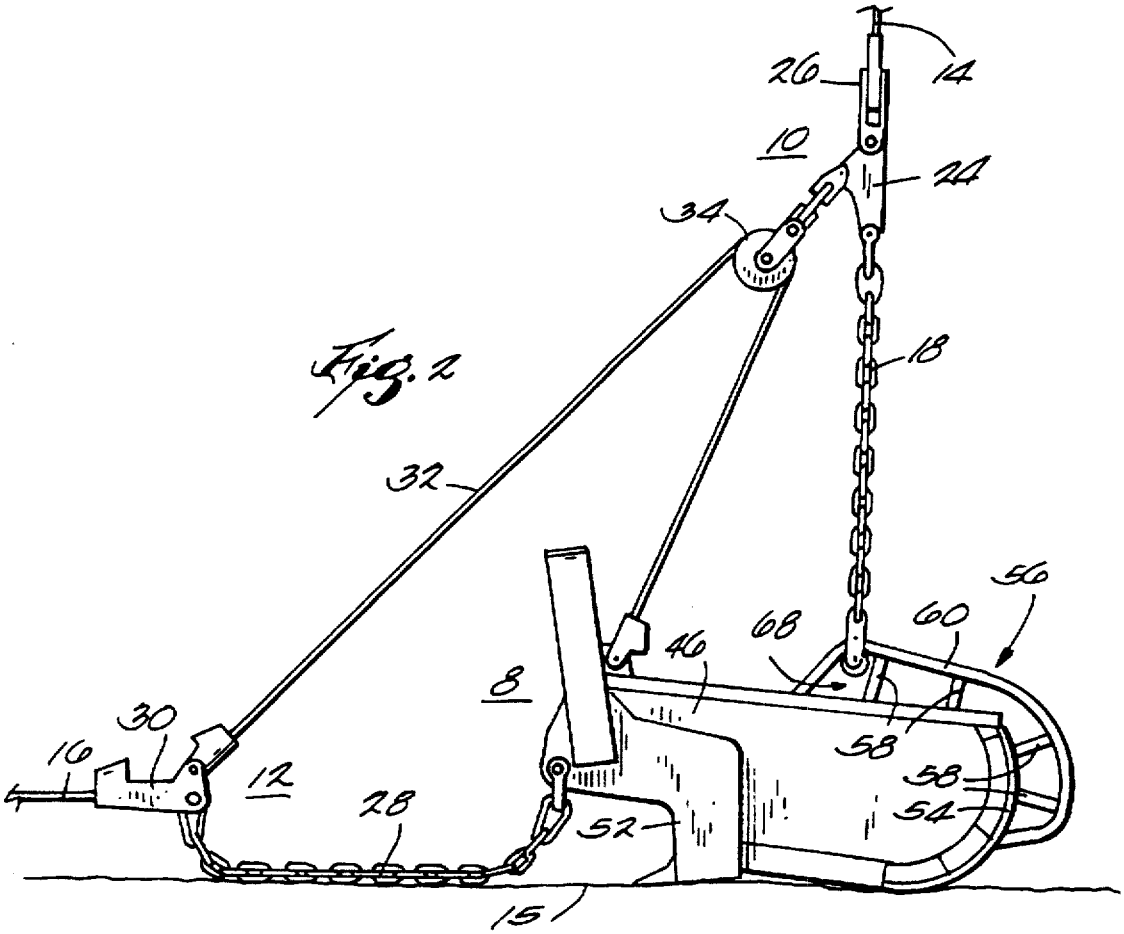
FIG. 2 is a side elevation view of the bucket having the dump system according to the invention.

Referring to FIG. 2, the bucket 8, the hoist system 10 and the drag system 12 are shown in greater detail. The hoist system 10 includes hoist chains 18, and 20, a center link 24 connected to an upper end of the hoist chains 18, 20 and a hoist link, socket and equalizer 26 connecting the hoist rope 14 to the center link 24. The drag system 12 includes a drag chain 28 connected to an open front end 5 of the bucket 8 and connected to a drag link 30 which, in turn, is affixed to the drag rope 16. Hoist or dump ropes 32 have opposite ends connected to the bucket 8 and the drag link 30 and are reeved over dump sheaves 34 attached to the center link 24 by a dump block equalizer linkage 36.

Referring further to FIGS. 1, 2 and 3A–C, the bucket 8 comprises a pair of side walls 46, 48 and a bottom wall 50 into which material being dug moves as the bucket is dragged in the direction of the open front end 52, as shown in FIG. 1. A rear wall 54 is connected to the side walls 46, 48 and the bottom 50. A dump rail assembly 56 is mounted on the side wall 46 and the rear wall 54 and includes support arms 58 and a contoured dump rail 60. A dump rail assembly 62 is mounted on the side wall 48 and rear wall 54 of the bucket. The dump rail assembly 62 includes a support wall 64 and a contoured dump rail 66.

Figure 4:
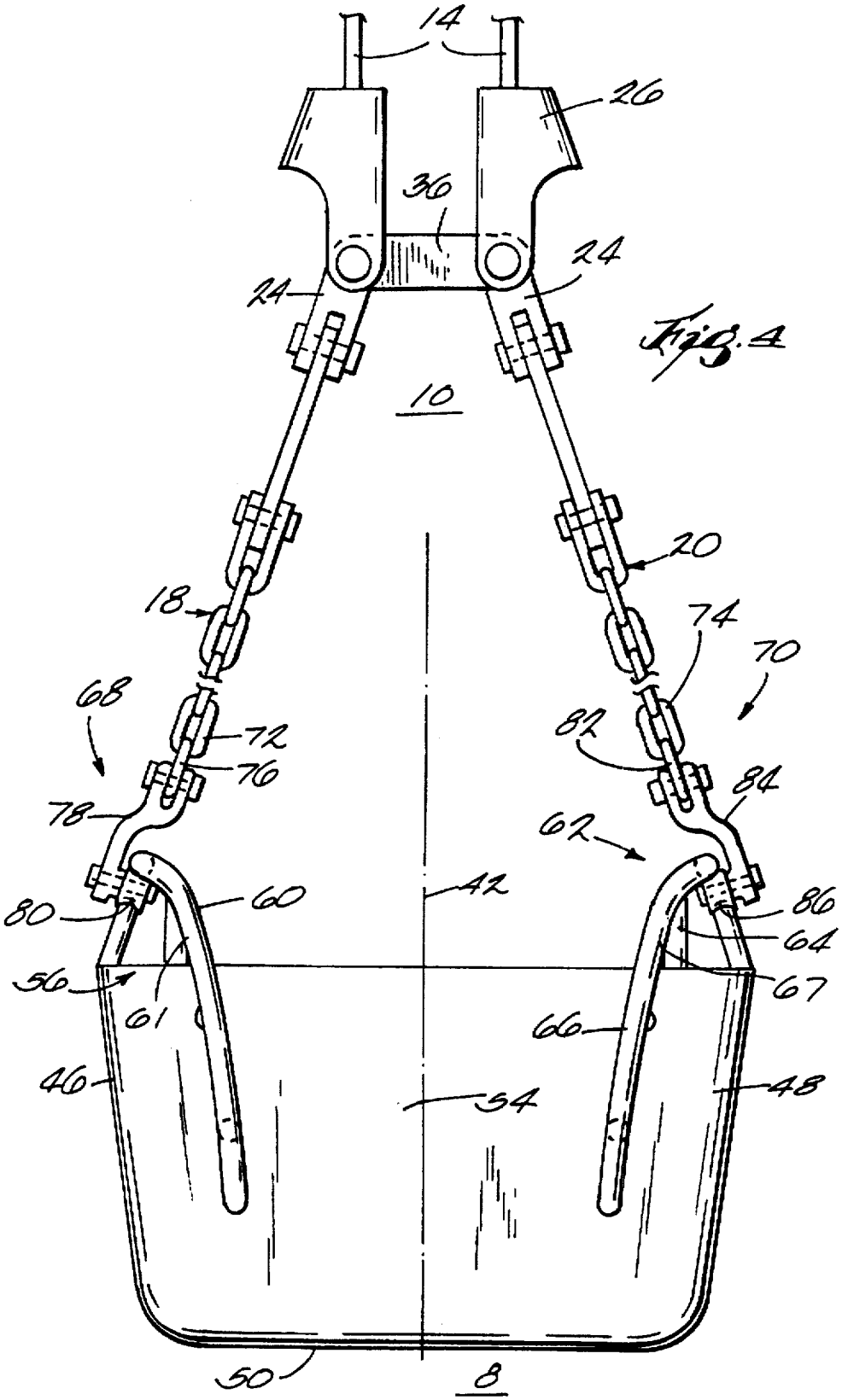
FIG. 4 is a rear elevation view of the bucket as shown in FIG. 3A.

The hoist chains 18 and 20 respectively include roller assemblies 68 and 70 at their lower ends 72 and 74. The roller assembly 68 includes a roller link 76 connected to the end 72 of the chain 18 and a roller arm 78 pivotally pinned to the roller link 76. A roller 80 is rotatably mounted on the roller arm 78 in engagement with the underside 61 of the contoured rail 60. The roller assembly 70 includes a roller link 82 pivotally connected to the end 74 of hoist chain 20, a roller arm 84 connected to the roller link 82, and a roller 86 rotatably mounted on the roller arm 84 in engagement with the underside 67 of the contoured rail 66. As can be best seen in FIG. 4, the contoured rails 60 and 66 are both inclined toward the vertical center line of the bucket 8 to the extent necessary to maintain the rollers 80 and 86 in alignment with the hoist chains to which they are connected. Thereby, the axis about which the rollers 80 and 86 rotate are perpendicular to the extended length of the respective hoist chains 18 and 20.

Figure 3B:
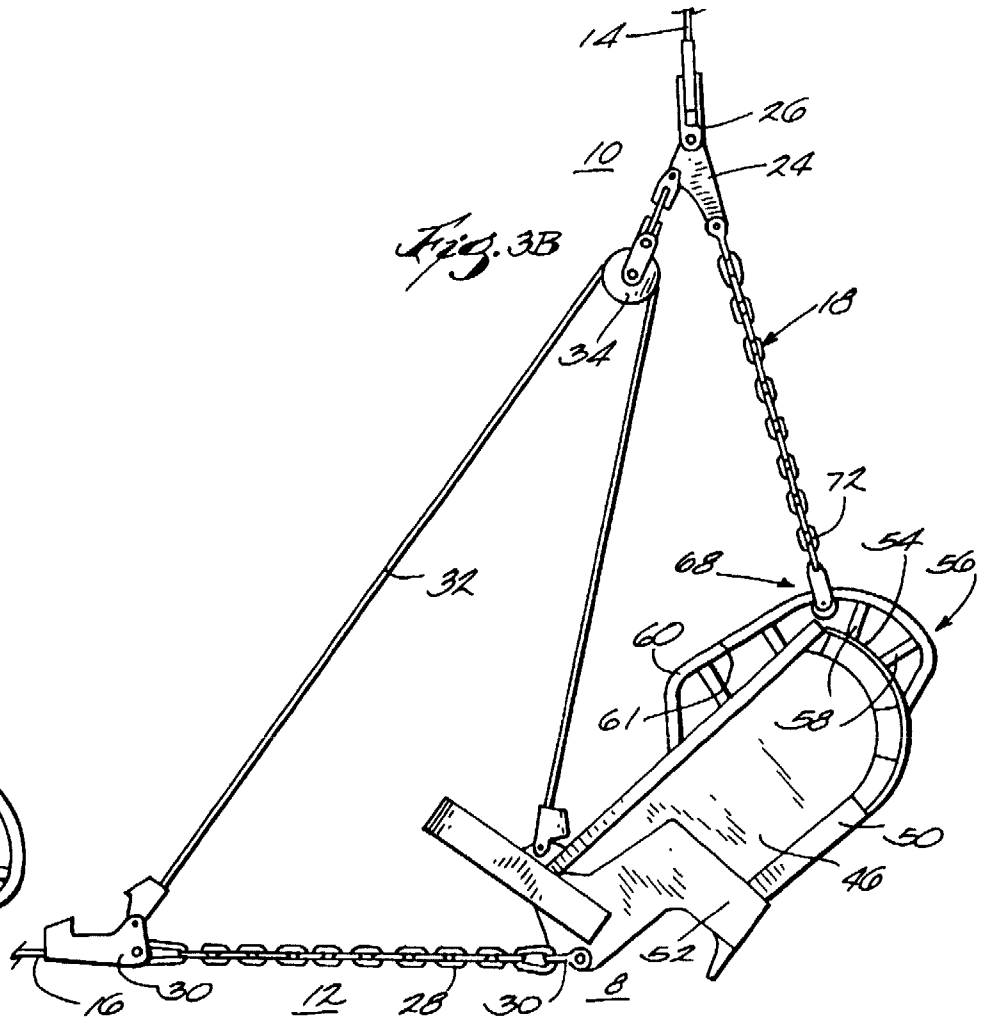
FIG. 3B is a side elevation view of the bucket shown in FIG. 3A with the bucket in a mid-dump position and the open end of the bucket facing partially downward.
Figure 3A:
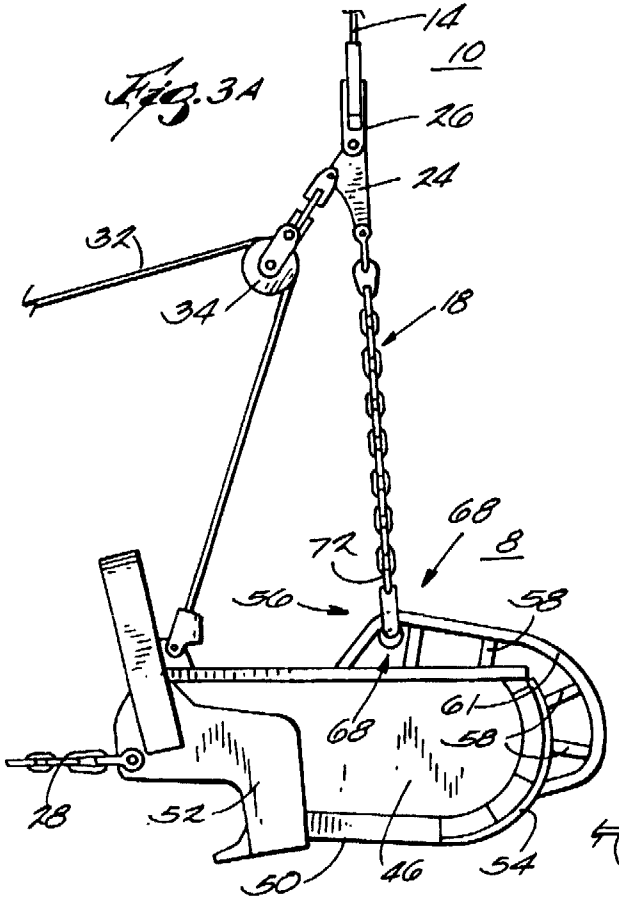
FIG. 3A is a side elevation view of the bucket shown in FIG. 2 suspended by a hoist rope with the open end of the bucket facing forward.

In its operation, the bucket 8 is dragged along the ground and into the material to be dug by the drag rope 16 until material moving through the open front end 52 of the bucket has moved into and loaded the bucket. With the drag rope 16 maintained sufficiently taut to keep the dump rope 32 correspondingly taut so that the open end 52 of the bucket is maintained facing forward or slightly upward, as shown in FIG. 3A, the hoist rope 14 is taken into the housing and frame 4 to lift the bucket. The machine housing and frame 4 and boom 6 are then swung to a location where it is desired to dump the material in the bucket. To dump the bucket, the drag rope 16 is released to thereby permit the dump rope 32 to relax. This permits the front open end 52 of the bucket to move downward toward and through a mid-dump position as shown in FIG. 3B. As the bucket begins its dumping movement, the roller assemblies 68 and 70 begin to roll respectively along the undersides 61 and 67 of the contoured rails 60 and 66 toward the rear wall 54 of the bucket. As the bucket continues to dump, the weight of the bucket and the material in it continues to lower the front open end 52 of the bucket until the bucket reaches its full dump position with the front open end facing substantially downward as shown in FIG. 3C. During the movement of the bucket to the full dump position, the roller assemblies 68 and 70 continue to follow the contour of the rails 60 and 66 to a position opposite the rear wall 54 of the bucket. The dumping operation is thus completed. In order to return the bucket to dig another load of material, tension is applied to the drag rope 16 to pull it into the housing and frame 4 to thereby put tension back into the dump ropes 32 and move the front open end 52 of the bucket back to a forward facing position, generally toward the housing and frame 4, as shown in FIG. 3A. During this movement of the bucket to bring the end 52 facing forward, the roller assemblies 68 and 70 move forward toward the open end 52 on the rails 60 and 66. Simultaneously to the movement of the bucket to the horizontal position, the main housing and frame 4 may be swung back to the digging area and the bucket lowered to the ground material being dug.

With reference to FIG. 6, an alternative embodiment of the dump system is illustrated in which the components are identical to those shown in FIGS. 2A–2C, 4 and 5, with the exception of the roller assemblies 68 and 70. The alternate embodiment relates to the roller assemblies, which are identical to each other, and therefore only one of the alternate roller assemblies will be described. In the embodiment of FIG. 6, the contoured rail 60 has a lower side 61 and an upper side 88. The roller assembly 90 has a roller arm 92 supporting both a lower roller 80 and a second upper roller 94 engaging the upper side 88 of the rail 60. The two rollers thus have a clamping action to securely hold the roller assembly 90 on the rail 60. At least one of the roller assemblies such as roller assembly 90 may include a speed control device in the form of a roller braking mechanism such as clutch plates 96 and 98.

Figure 7:
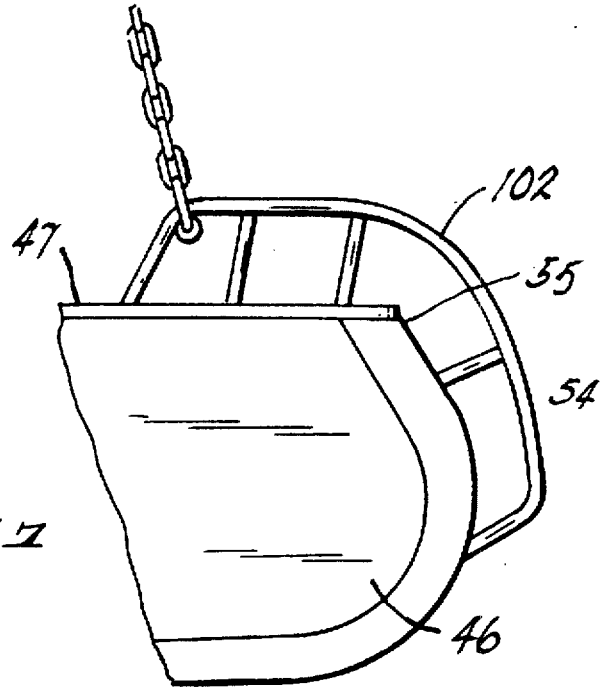
FIG. 7 is a side elevation view illustrating an alternative embodiment of the invention.
Figure 8:
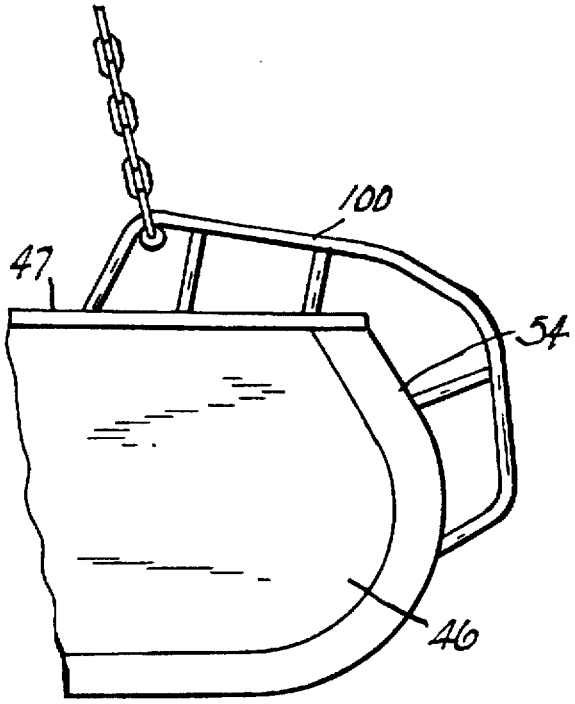
FIG. 8 is a side elevation view illustrating a further alternative embodiment of the invention.

Further alternative embodiments of the dump system are shown in FIGS. 7 and 8 and relate to the contour of the dump rails. In FIG. 7, the dump rail 100 follows a path somewhat parallel to the top edge 47 of the sidewall 46 relative to the view of FIG. 7, until the rail 100 is approximately opposite the rear wall 54. This contour has the effect of slowing the movement of the bucket in its return to a horizontal or digging position.

In FIG. 8, the dump rail 102 follows a path having a relatively larger curvature than rail 60 in the portion of the rail 102 opposite the upper portion 55 of the rear wall 54.

As may be appreciated from the foregoing description, the dumping system according to the invention locates the components of the dumping system away from the flow of the material being dug and its abrasive wear effects. Further, the components of the dumping system are positioned such that they do not interfere with material flow inside of the bucket or interfere with the bucket moving through the material outside of the bucket.

It will be understood that the foregoing description of the present invention is for purposes of illustration only and that the invention is susceptible to a number of modifications or changes, none of which entail any departure from the spirit and scope of the present invention as defined in the hereto appended claims.

What is claimed is:

1. An improved dumping system for a dragline bucket for digging, carrying and dumping material, the bucket having first and second spaced apart side walls, a rear wall and a forward open end, the improvement comprising:

a first dumping rail supported by the first side wall and extending along a first path from above the first side wall to adjacent the rear wall and a second dumping rail supported by the second side wall and extending along a second path from above the second side wall to adjacent the rear wall;

bucket hoist means for lifting and lowering and suspending the bucket above the ground;

a drag rope for dragging the bucket along the ground and attached to the bucket forward open end, a dump sheave attached to the bucket hoisting means, a dump rope attached to the drag rope and attached to the bucket forward open end and reeved over the dump sheave, and bucket support means, connected to the hoist means and including roller means engaging the first and second dumpling rails for supporting the bucket in a suspended manner, the roller means being movable along the dumping rails from a forward position in which the open end of the bucket faces substantially horizontally to a rearward position in which the open end of the bucket faces downwardly.

2. The improved dumping system in accordance with claim 1 wherein:

the first dumping rail has a length and the second dumping rail has a length; and each dumping rail is angled transversely to said dumping rail's length relative to the side wall on which said dumping rail is supported in a direction upward and toward the sidewall on which the other dumping rail is supported.

3. The improved dumping system in accordance with claim 2 wherein:

the bucket hoist means includes a first hoist chain having a length extending from above the bucket downward at a first angle to adjacent the first dumping rail and a second hoist chain having a length extending from above the bucket downward at a second angle to adjacent the second dumping rail; and the roller means comprises first and second roller means respectively connected to the first and second hoist chains, the first roller means having at least one first roller engaging the first dumping rail, said first roller having an axis substantially perpendicular to the length of the first hoist chain, the second roller means having at least one second roller engaging the second dumping rail, said second roller having an axis substantially perpendicular to the length of the second hoist chain.

4. The improved dumping system in accordance with claim 1 wherein the first and second dumping rails each have a section positioned opposite and spaced from the rear wall.

5. The improved dumping system in accordance with claim 1 wherein:

the bucket has a substantially horizontal digging position and a bottom wall; and in the said dragging position of the bucket, each dumping rail has a forward section spaced from and positioned above the bucket and a rear section spaced from and positioned to the rear of the bucket and above said bottom wall, whereby the roller means is not engaged by material being dug.

6. The improved dumping system in accordance with claim 1 wherein each dumping rail has a length and a contour along said length affecting the rate of movement of the bucket along the dumping rails.

7. The improved dumping system in accordance with claim 1 wherein:

the first and second dumping rails each include upper and lower sides; and the roller means includes first and second rollers respectively engaging the lower and upper sides of the first dumping rail and third and fourth rollers respectively engaging the lower and upper sides of the second dumping rail.

8. The improved dumping system in accordance with claim 1 wherein:

the roller means includes at least one first roller in engagement with the first dumping rail and at least one second roller in engagement with the second dumping rail; and the roller means further includes first and second speed control means for respectively limiting the speed of the first and second rollers.

9. The improved dumping system in accordance with claim 8 wherein:

the first and second dumping rails each include upper and lower sides;

the roller means includes first and second rollers respectively engaging the lower and upper sides of the first dumping rail and third and fourth rollers respectively engaging the lower and upper sides of the second dumping rail.

10. The improved dumping system in accordance with claim 8 wherein each first and second speed control means comprises a brake mechanism.

11. The improved dumping system in accordance with claim 8 wherein each first and second speed control means comprises a clutch mechanism.

12. An improved dumping system for a dragline bucket having first and second sidewalls, a rear wall, and carrying and dumping positions, the improvement comprising;

a first dumping rail supported by the first side wall and extending from the first side wall to the rear wall and a second dumping rail supported by the second side wall and extending from the second side wall to the rear wall;

bucket hoist means for lifting and lowering and suspending the bucket above the ground;

a drag rope for dragging the bucket along the ground and attached to the bucket forward open end, a dump sheave attached to the bucket hoisting means, a dump rope attached to the drag rope and attached to the bucket forward open end and reeved over the dump sheave; and first and second roller means respectively below and in upward supporting engagement with the first and second dumping rails and connected to the hoist means for supporting the bucket such that the bucket is movable along the rails on the roller means between said carrying and dumping positions.

13. The improved dumping system in accordance with claim 12 wherein:

the bucket hoist means includes a first hoist chain having a length extending from above the bucket downward at a first angle to adjacent the first dumping rail and a second hoist chain having a length extending from above the bucket downward at a second angle to adjacent the second dumping rail; and the roller means comprises first and second roller means respectively connected to the first and second hoist chains, the first roller means having at least one first roller engaging the first dumping rail, said first roller having an axis substantially perpendicular to the length of the first hoist chain, the second roller means having at least one second roller engaging the second dumping rail, said second roller having an axis substantially perpendicular to the length of the second hoist chain.

14. The improved dumping system in accordance with claim 12 wherein:

the roller means includes at least one first roller in engagement with the first dumping rail and at least one second roller in engagement with the second dumping rail; and the roller means further includes first and second speed control means for respectively limiting the speed of the first and second rollers.

15. The improved dumping system in accordance with claim 12 wherein:

the bucket has a substantially horizontal digging position and a bottom wall; and in the said dragging position of the bucket, each dumping rail has a forward section spaced from and positioned above the bucket and a rear section spaced from and positioned to the rear of the bucket and above said bottom wall, whereby the roller means is not engaged by material being dug.

* * * * *